US008584571B2

(12) United States Patent
Armellino, Jr.

(10) Patent No.: US 8,584,571 B2
(45) Date of Patent: Nov. 19, 2013

(54) BALLISTIC PROTECTION APPARATUS

(75) Inventor: Richard A. Armellino, Jr., Lancaster, PA (US)

(73) Assignee: Baker Ballistics, LLC, Lititz, PA (US)

( * ) Notice: Subject to any disclaimer, the term of this patent is extended or adjusted under 35 U.S.C. 154(b) by 0 days.

(21) Appl. No.: 13/276,420

(22) Filed: Oct. 19, 2011

(65) Prior Publication Data

US 2013/0098234 A1 Apr. 25, 2013

(51) Int. Cl.
*F41H 5/08* (2006.01)

(52) U.S. Cl.
USPC ..... 89/36.05; 89/36.07; 89/36.01

(58) Field of Classification Search
USPC ..... 89/36.07, 36.02, 36.06, 903, 918, 926, 89/36.05, 36.14, 36.01; 2/2.5
See application file for complete search history.

(56) References Cited

U.S. PATENT DOCUMENTS

| | | | | |
|---|---|---|---|---|
| 1,294,191 | A * | 2/1919 | Suderlock | 160/135 |
| 3,745,938 | A * | 7/1973 | Hathaway et al. | 109/49.5 |
| 4,674,394 | A * | 6/1987 | Martino | 89/36.05 |
| 5,293,807 | A * | 3/1994 | Hajdu | 89/36.07 |
| 5,377,577 | A * | 1/1995 | Bounkong et al. | 89/36.05 |
| 6,691,601 | B2 * | 2/2004 | Cohen et al. | 89/36.05 |
| 6,807,890 | B1 * | 10/2004 | Fuqua | 89/36.02 |
| 8,210,088 | B1 * | 7/2012 | Keyfauver | 89/36.05 |
| 2005/0217472 | A1 * | 10/2005 | Baker | 89/36.06 |
| 2006/0230916 | A1 * | 10/2006 | Sand | 89/36.07 |
| 2007/0193441 | A1 * | 8/2007 | Carter | 89/36.07 |
| 2007/0283477 | A1 * | 12/2007 | Dovner | 2/2.5 |

OTHER PUBLICATIONS

Miller, "Body Armor Update: 2011—The 18th Annual Report on the Latest Advances in Ballistic Armor Technology and Design," P&SN Police and Security News, The Information Source for Law Enforcement and Homeland Security, vol. 27 Issue 4, Jul./Aug. 2011, pp. 1-5.
Weiss, et al., "Mobile Rifle Armor Protective Shield (MRAPS)," Law and Order Magazine, Mar. 2011.
"Baker Ballistics to Introduce Tactical Rifle Shield," Police the Law Enforcement Magazine, Community for Cops, Jan. 15, 2011.
Weiss, et al., "Mobile Rifle Armor Protective Shield (MRAPS)," Herndon Publishing Company via Law and Order Magazine, Mar. 2011.
"Baker Ballistics Rifle Shield Completes Testing," Police the Law Enforcement Magazine, Community for Cops, Nov. 3, 2010.

* cited by examiner

*Primary Examiner* — Michelle Clement
*Assistant Examiner* — John D Cooper
(74) *Attorney, Agent, or Firm* — Nixon & Vanderhye, P.C.

(57) ABSTRACT

A ballistic protection apparatus that is lightweight and easy to operate, while at the same time maintaining the integrity of protection of the shield throughout the entire shield is provided. The technology described herein also incorporates a dual function "quick release/spreader" assembly device. The shield user can cradle the weight of the shield in the crook of the elbow region of the support inner arm, which provides exceptional stabilization when there is no time available to hook up the ballistic shield to the wearer's tactical attire. The technology described in this specification also provides a tapered platform device that provides a self-aligning weapon indexing cradle allowing the shield user to accurately return the weapon's aimed impact point back on target following inherent up and down and side to side shaking movements of a recoiling weapon during the firing process.

14 Claims, 14 Drawing Sheets

BALLISTIC PROTECTION APPARATUS

BACKGROUND

Ballistic protection apparatuses, such as a ballistic shield, are used for a variety of different applications. For example, military personnel can use the ballistic shields in close combat with an enemy so that they can protect several of their vital organs from damage. Law enforcement personnel can also use the ballistic shields for protection during tactical operations, or for use as a non-combative measure for crowd control.

Ballistic shields have evolved over the years. Many are made of materials that make them relatively light in weight but still extremely protective. Some ballistic shields even allow for the ability to mount or place a weapon on the shield so the operator can handle both the weapon and the shield itself, using the shield as both the shield and the sword, so to speak.

Despite the light weight of many ballistic shields, operators still experience fatigue when holding their shields with or without their weapons. For example, a soldier may have to carry the shield when walking through a hostile town for 30 to 40 minutes, or more. Even if the soldier has a shield with reduced weight, the action of carrying and holding the shield will fatigue the soldier. Therefore it is desirable to improve the manner in which an operator can hold and use the shield.

One way to improve the operator's ability to hold and use the shield is to attach separate hardware to the shield allowing the operator to more easily hold the shield or attach the shield to a separate device. This can be accomplished by altering the shield structure so that devices can be connected and/or mounted to the shield. An additional device for holding the shield can be attached to the shield using through-bolts, for example.

However, when altering the shield structure so that additional devices can be attached to the shield, the shield itself becomes vulnerable at the various connection points. For example, the armor would be weaker in a region where a through-bolt may attach an additional device. Therefore, there is a need to provide a ballistic protection apparatus that can be lightweight and easily held by an operator while at the same time maintaining the structural integrity of the shield so that the shield remains strong throughout.

BRIEF SUMMARY

The technology described in this application attempts to solve these problems by providing a ballistic protection apparatus that is lightweight and easy to operate, while at the same time maintaining the integrity of protection of the shield. One way of achieving this is by providing a partial hybrid or full composite armor protective shield panel to be held by the shield bearer in front of the body by using a combination of armored through-bolts, standoff rods, slip joints, friction collars, and shock absorbing rotatable/adjustable handhold that serve the multiple functions of providing a protective standoff and a shock absorbing resting/leverage platform for the supportive hand and forearm. Simultaneously, the inside back-face surface and the outer perimeter edges are allowed to expand, contract and deform without losing the collective ability to stay fully attached to the shield in a functional load-bearing capacity, thereby greatly reducing the chances of hardware detaching from the composite armor panel during a dangerous firefight, thereby allowing the armor to fail, fall and/or be forced into a non-protective position.

The technology also protects and insulates the supporting arm and hand of the user from high levels of impact energy by the standoff position allowed by the shock absorbing hardware, reducing the chances that the shield user will drop the shield following the experience of pain and/or possible wrenching of the composite armor while it captures incoming projectiles during a dangerous ballistic impact event.

Another aspect to the technology described in this specification is the incorporation of two substantial lengths of rubber "bungee" attachments designed to allow the shield user to, in a "hands-free" manner, position the shield in a high and vertically stable protective position, which grants the user the ability to free up both hands while remaining in a very protected and stable position without the use of a supportive arm/hand. The attachments allow for the effective use and positioning of an offensive and protective handgun and/or long-gun without interference from the interior shield surface and/or attachment hardware, and offers a method of reliable quick release of the entire protective shield, at the user's discretion.

The technology described herein also incorporates a dual function "quick release/spreader" assembly device. The shield user can cradle the weight of the shield in the crook of the elbow region of the support inner arm, which provides exceptional stabilization when there is no time available to hook up the ballistic shield to the wearer's tactical attire. This device also grants the user the option of repositioning this device via its two releasable buckles/web straps, and attaching the device (with the shield suspended below the quick release/spreader assembly) to an upper region of the wearer's torso utilizing an anchor point provided by the ballistic protective vest, or harness designed to accommodate the two anchor points.

In addition to the above-mentioned features, the technology described in this specification also provides a tapered platform device that provides a self-aligning weapon indexing cradle allowing the shield user to accurately return the weapon's aimed impact point back on target following inherent up and down and side to side shaking movements of a recoiling weapon during the firing process. The shape of the top surface of the shooting platform can allow the bottom surface of the weapon's forestock to fall back into a continually reduced laterally tapered channel, so that ultimately the bottom and lower side surfaces of the weapon is cradled into a position perpendicular to the upper perimeter surface of the ballistic shield.

In certain example embodiments, a ballistic protection apparatus is provided having a ballistic shield having a body formed at least in part of a ballistic material, the body of the ballistic shield having at least one edge, and having an armored attachment portion configured for attaching to the at least one edge of the body of the ballistic shield, the armored attachment portion configured to armor a portion of the ballistic shield where armor in the body of the ballistic shield is weakened.

According to an aspect of certain example embodiments, another ballistic protection apparatus is provided having a ballistic shield having a body formed at least in part of a ballistic material, and having an attachment portion configured to attach to/detach from the body of the ballistic shield, where the attachment portion is further configured to allow an operator of the ballistic protection apparatus to operate the ballistic protection apparatus with at least one hand of the operator free from holding the ballistic protection apparatus.

According to an aspect of certain example embodiments, another ballistic protection apparatus is provided having a ballistic shield having a body formed at least in part of a ballistic material, the ballistic shield having a grooved portion, and having an armored weapon support portion configured to be connected to the ballistic shield and placed in the grooved portion of the ballistic shield, the armored weapon support portion having a tapered groove configured to hold a weapon and to allow the weapon to return to an initial state after weapon operation.

In a non-limiting, example implementation the ballistic shield also has a grooved portion on at least one edge of the ballistic shield, and an opening in a vicinity of the grooved portion, the opening configured to receive connection devices for coupling the armored attachment portion to the ballistic shield.

In another non-limiting, example implementation the ballistic protection apparatus also has a locking device, and a connection device configured to connect the armored attachment portion to the ballistic shield, where the connection device is configured to be first inserted into an opening on the armored attachment portion and then inserted into the opening in the vicinity of the grooved portion on the ballistic shield, and the connection device is further configured to be fastened and locked by the locking device so that the armored attachment portion is tightly connected to the ballistic shield.

In yet another non-limiting, example implementation, the ballistic protection apparatus also has a first armored attachment portion having a first bracket assembly, a second armored attachment portion having a second bracket assembly, a first edge located on a first side of the ballistic shield, and a second edge located on a second side of the ballistic shield, the second side directly opposing the first side of the ballistic shield, wherein the first armored attachment portion is coupled to the first edge and the second armored attachment portion is coupled to the second edge, the first armored attachment portion directly opposing the second armored attachment portion.

In another non-limiting, example implementation the first bracket assembly has a first collar portion and a second collar portion, both the first and second collar portion are configured to be connected to the first bracket assembly, and the second bracket assembly has a third collar portion and a fourth collar portion, both the third and fourth collar portion are configured to be connected to the second bracket assembly.

In a non-limiting, example implementation the ballistic protection apparatus also has a first rod configured to connect to both the first and second bracket assembly, and a second rod configured to connect to both the first and second bracket assembly, where the first and second rods lie parallel to each other when connected to the first and second bracket assemblies.

In another non-limiting, example implementation the first rod is configured to be coupled to and fastened to the first bracket assembly via the first collar portion and configured to be coupled to and fastened to the second bracket assembly via the third collar portion, and the second rod is configured to be coupled to and fastened to the first bracket assembly via the second collar portion and configured to be coupled to and fastened to the second bracket assembly via the fourth collar portion.

According to another aspect of certain example embodiments, the attachment portion also has a spreader assembly having a first connection portion and a first buckling device, and a bungee cord having a first end configured to connect to the ballistic shield, a second end oppositely located to the first end and configured to connect to the first connection portion of the spreader assembly, and a second buckling device configured to connect to the first buckling device of the spreader assembly, where the spreader assembly is configured to be operatively detachable from the bungee cord by unbuckling the first buckling device of the spreader assembly from the second buckling device of the bungee cord.

In a non-limiting, example implementation the spreader assembly is further configured to be attached to a vest or harness worn by the operator, via a third buckling device, so that the operator can benefit from the ballistic protection apparatus without carrying the weight of the ballistic protection apparatus in the hands and arms.

In another non-limiting, example implementation the grooved portion is on a top side of the ballistic shield allowing an operator to mount the weapon so that the weapon rests on the ballistic shield and extends beyond a front face of the ballistic shield.

According to another aspect of certain example embodiments, the ballistic protection apparatus also has an opening in a vicinity of the grooved portion, the opening configured to receive connection devices for coupling the armored weapon support portion to the ballistic shield, a locking device, and a connection device configured to connect the armored weapon support portion to the ballistic shield. The connection device is configured to be first inserted into an opening on the armored weapon support portion and then inserted into the opening in the vicinity of the grooved portion on the ballistic shield, and the connection device is further configured to be fastened and locked by the locking device so that the armored weapon support portion is tightly connected to the ballistic shield.

The features, aspects, and advantages described above may be combined in any suitable combination or sub-combination to realize yet further embodiments.

DETAILED DESCRIPTION

Pressed, cast, poured and/or molded armor panels in ballistic shields comprise partially and/or fully of chemically reinforced layers of structural reinforcing fibers such as aramid, polyethylene, fiberglass and the like, are subject to deforming and changing shape while these semi-rigid, and/or rigid panels absorb, transfer and mitigate the energy from impacting projectiles.

As the material density and overall mass of the armor panel is reduced, the inherent ability of the armor to instantly absorb and mitigate the projectile's energy while enabling the shield bearer to retain control of the armor in a protective position between the incoming projectiles and the user becomes challenging. During ballistic impact, a portion of the projectile's energy transfers to the user's supportive arm and hand while dimensional changes to the size and shape of the composite armor panel's outer perimeter edges and rear face surface occur.

Hardware can thus be attached to the shield in order to address these issues that occur during ballistic impact. However, any weight reduction benefits inherent to the lighter weight composite armor panel are partially or fully negated when associated hardware necessary for carrying, positioning and absorbing projectile impact energy requires use of robust and heavy supportive hardware and impact absorbing devices. In other words, even though shields are designed to be lighter in weight, this advantage is reduced by having to attach robust and heavy supportive hardware to the shield for operation and/or storage.

Furthermore, in current practice, through-bolts and attachments to the armor's inside surface for attaching additional hardware reduce the inherent ballistic strength of the armor by modifying and restricting the armor's ability to instantaneously change shape, which is necessary to effectively capture a projectile during the ballistic impact event. That is, the through-bolts and attachments allow for the convenience of attaching other devices to the shield but at the same time weaken the shield in those regions.

It is also generally known and realized that carrying protective ballistic shields in front of the body for long periods of time results in fatigue to the user. The use of a flexible strap(s) to allow portions of the user's upper body to provide support to the ballistic shield to help reduce the shield's weight carried in the supportive arm in order to reduce fatigue is problematic due to: reduction in ability to effectively change position of the protective ballistic shield during a dynamic fast-moving gunfight; difficultly in using weaponry to defend oneself during a gunfight while properly indexed into a position in close proximity to a ballistic shield; and the quick ability to simply, reliably, and completely release the shield, at the user's discretion. The ballistic protection apparatus discussed herein improves upon such disadvantages.

Figure 1:
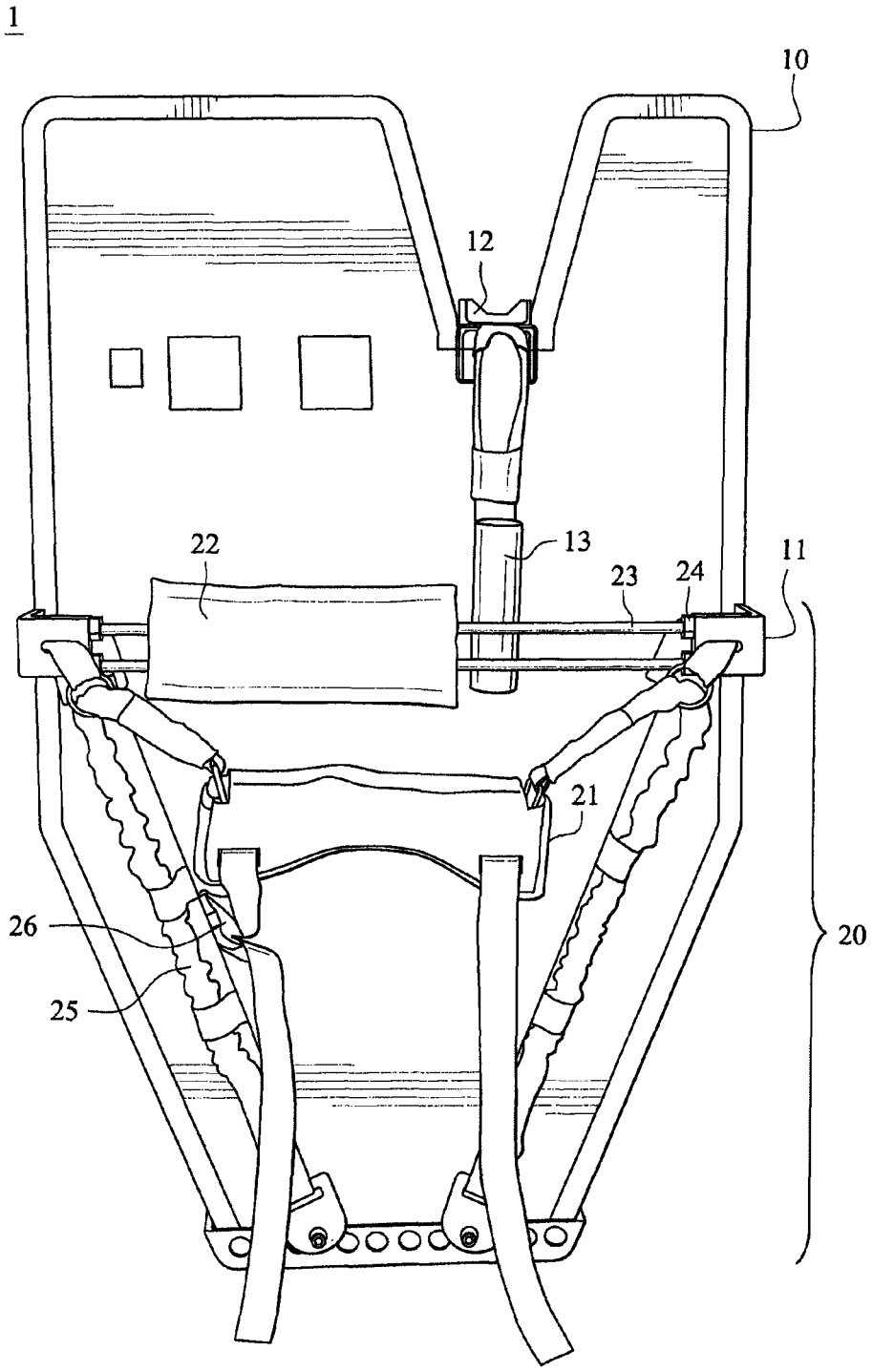
FIG. 1 shows a perspective view of an example ballistic protection apparatus.

FIG. 1 shows a perspective view of an example ballistic protection apparatus 1. The ballistic protection apparatus 1 can have a shield portion 10 and an attachment portion 20.

The shield portion 10 can have brackets 11 attachable to the shield portion 10 and at least one weapon support device 12 for holding at least one armored weapon. The shield portion 10 is also configured to provide a handle 13 for allowing an operator to "grip" the device with one or more hands. It should be appreciated that the shield portion 10 can be made from, for example, partially and/or fully chemically reinforced layers of structural reinforcing fibers such as aramid, polyethylene, and/or fiberglass. The shield portion 10 can also be made from other materials such as a hard plastic or a metal, such as iron or steel.

The attachment portion 20 can include rods 23 and collars 24 that are configured to connect to the brackets 11. The rods 23 are inserted into the brackets 11 through the collars 24 where the collars 24 can be configured to tighten the rods 23 to the brackets 11. The rods 23 and collars 24 also allow the attachment portion 20 to attach devices to the shield portion 10. The rods 23 also provide the further advantage of "sliding" in-and-out of the brackets 11 when the shield portion 10 is impacted by a projectile. The movement of the rods 23 allows the shield portion 10 to better absorb the impact of the projectile without damaging the shield portion 10.

The attachment portion 20 can also have a spreader assembly 21 that is configured to connect to the attachment portion 20 or to another device. The spreader assembly 21 can be used to allow an operator to hold the ballistic protection apparatus 1 by wrapping an arm underneath the assembly 21 so that the assembly 21 rests near the operator's elbow, for example. As discussed below, the spreader assembly 21 is configured in this view to be attached to the attachment portion 20 thereby being coupled to the shield portion 10. However, the spreader assembly 21 can detach from the shield portion 10 so that it can connect to an operator, for example. This allows the operator to connect the shield portion 10 to equipment being worn by the operator so the operator can use the ballistic protection apparatus 1 without having to use their hands to hold the shield.

The spreader assembly 21 can be detached by operating the buckles 26. Although not limited to this embodiment, the attachment portion 20 can have two buckles 26, located on opposite sides of the spreader assembly 21. The two buckles are discussed further in the description of FIG. 5*a* below.

The attachment portion 20 can also have a spreader pad 22. The spreader pad 22 can, for example, provide comfort to a user that is holding the protection apparatus 1 by putting his/her arm underneath the spreader assembly 21. The attachment portion 20 also has bungees 25 for allowing the spreader assembly 21 to freely move when operating the protection apparatus 1.

Figure 2:
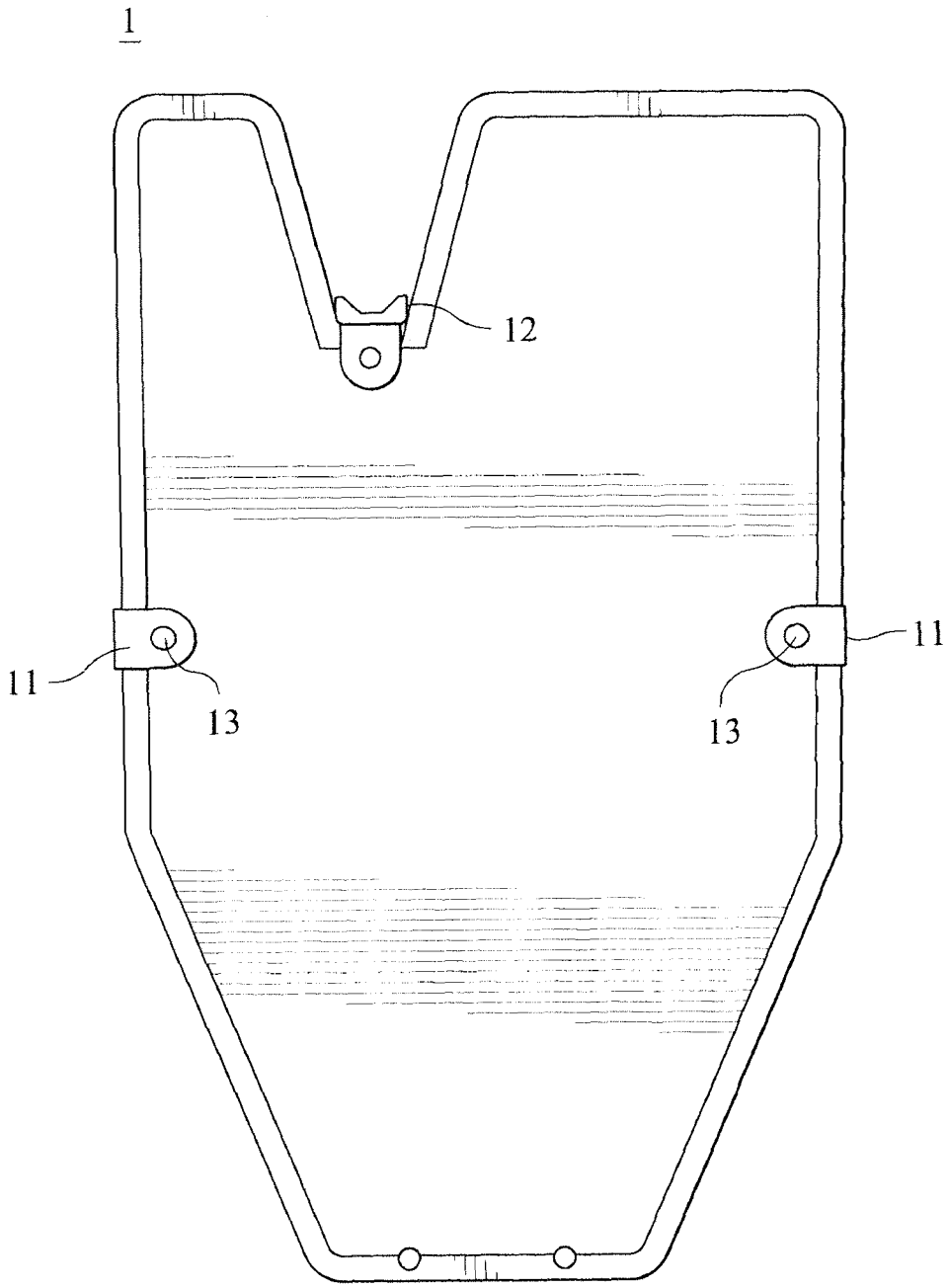
FIG. 2 shows a front view of the ballistic protection apparatus.

FIG. 2 shows a front view of the ballistic protection apparatus 1. This view of the ballistic protection apparatus shows the brackets 11 on opposing sides of the apparatus 1 and the weapon support device 12 on a top portion of the apparatus 1. The weapon support device 12 is configured to support at least one weapon by allowing a user to position the weapon in the support device 12. The user can the rest the weapon in the support device 12 while at the same time look through a groove in the apparatus 1.

The brackets 11 and weapon support device 12 are configured to be attached to the apparatus 1 by virtue of bolts 13. It should be appreciated that the brackets 11 and the weapon support device 12 are pieces of armor on the apparatus 1 as well. For example, the brackets 11 and weapon support device 12 may be made of a metal material, such as Titanium. Of course, other materials could be used as well and the brackets 11 and weapon support device 12 are not limited to a metal material.

In this manner, the apparatus 1 that would normally be weakened in areas where portions connect to the apparatus 1 are now strengthened in that the areas are armored in and of themselves. In other words, if the brackets 11 and weapon support device 12 were not armored portions, the apparatus 1 would be weak in these areas and may be prone to destruction of the apparatus 1 when a projectile hits these portions of the apparatus 1.

Figure 3A:
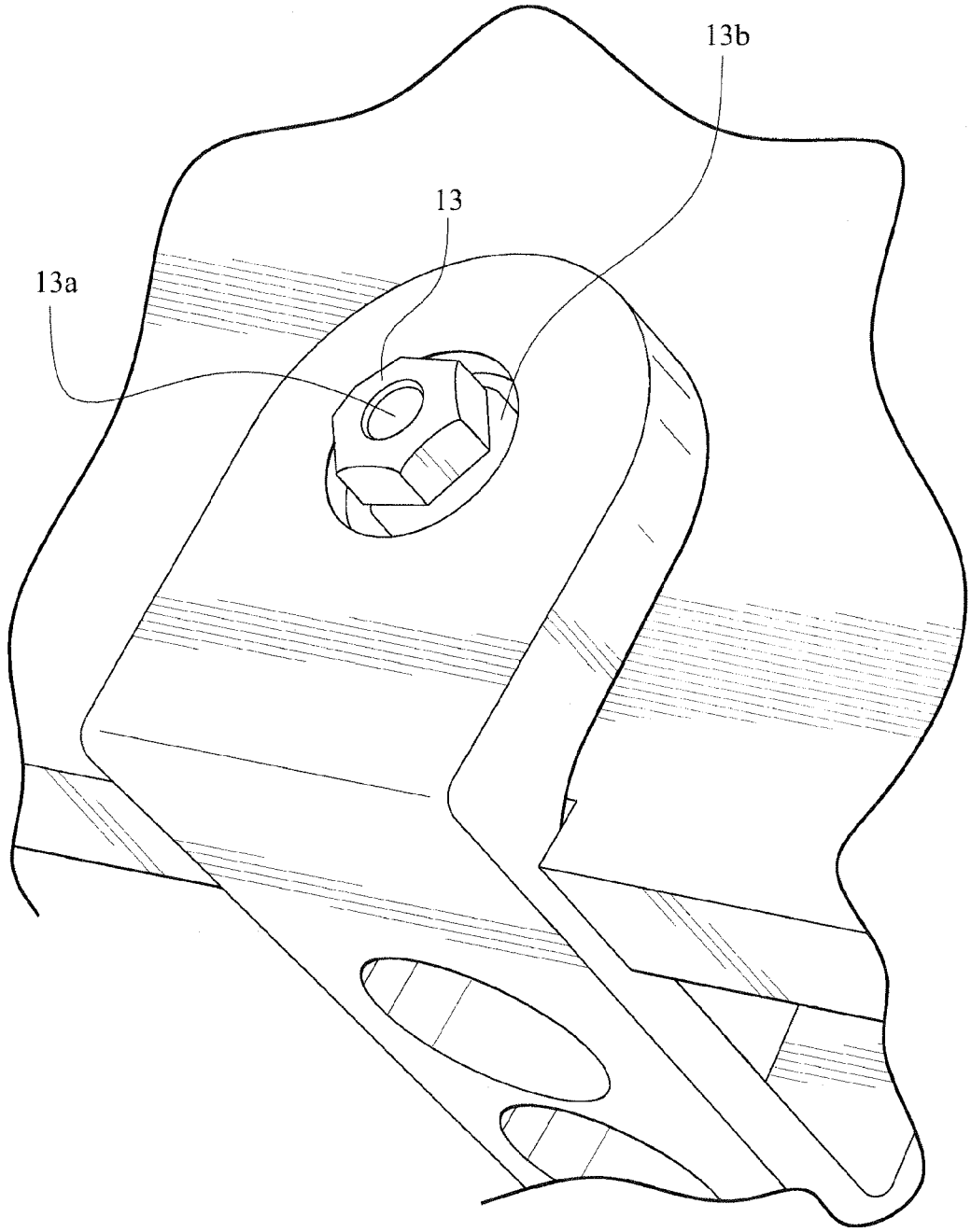
FIG. 3*a* shows an exploded view of brackets attached to the ballistic protection apparatus.

FIG. 3*a* shows an exploded view of the brackets 11 attached to the ballistic protection apparatus 1. Although not limited to this particular embodiment, the brackets 11 are configured to be attached to the apparatus 1 by way of a combination of a bolt 13, a screw 13*a*, and an armored through-bolt 13*b*. In this example, the armored through-bolt 13*b* is designed to connect the bracket 11 by inserting a screw 13*a* into the armored thru-bolt 13*b*. The bolt 13 is then used to fasten and lock in the bracket 11 by tightening the bolt 13 to the screw 13*a*.

Figure 3B:
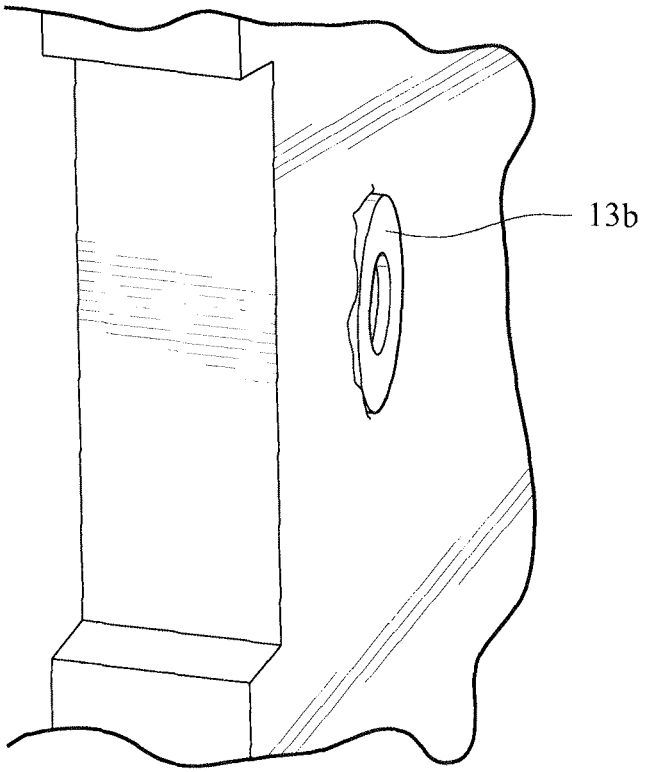
FIG. 3*b* shows an exploded view of the apparatus where the bracket is not connected to the apparatus.

FIG. 3*b* shows an exploded view of the apparatus 1 where the bracket 11 is not connected to the apparatus 1. FIG. 3*b* shows the armored thru-bolt 13*b* without the inserted screw 13*a* and the bolt 13.

Figure 4:
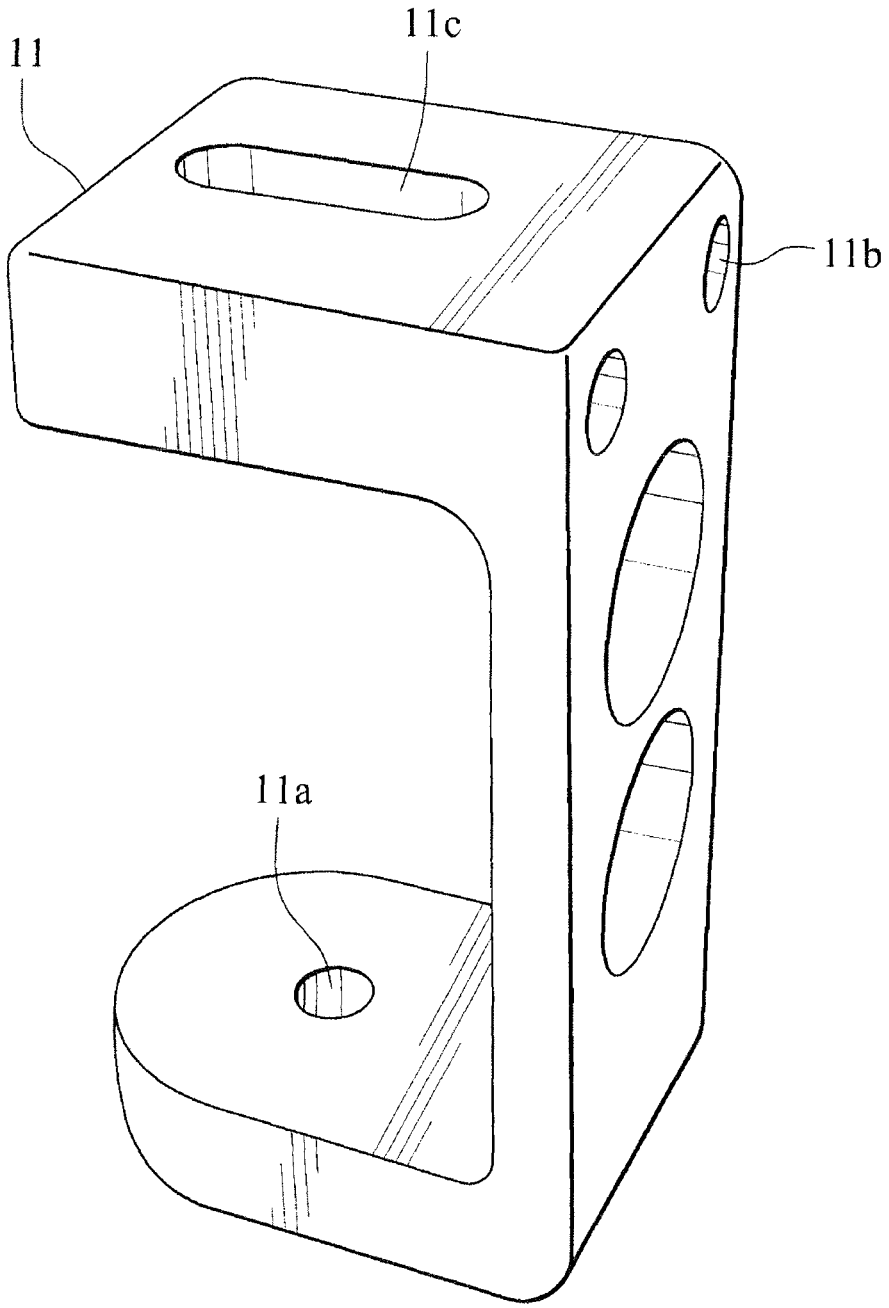
FIG. 4 depicts a bracket that is attached to the ballistic protection apparatus.

FIG. 4 depicts an enhanced view of a bracket 11. The bracket 11 is configured to have several openings for connecting various items to the bracket 11. For example, the bracket 11 can have a bracket connection opening 11*a* for inserting the above-mentioned screw 13*a*. This allows the bracket 11 to be fastened to the apparatus 1 by inserting the screw 13*a* into the connection opening 11*a* and then fastening the screw with the bolt 13.

The bracket 11 can also have a rod opening 11*b*. This allows the afore-mentioned rods 23 to be connected to the bracket 11 by inserting them through the rod opening 11*b*. It should be appreciated that the rods 23 will be first inserted through collars 24. The collars 24 can be configured to fasten the rods 23 to the bracket 11. For example, an Allen wrench may be used to rotate the collar 24 so that it fastens the rod 23 to the bracket 11.

The bracket 11 can also be configured to have a belt opening 11*c* that allows the bungees 25 to connect to the bracket 11. As can be seen in FIG. 1, the bungees 25 connect to a belt portion that is inserted into the belt opening 11*c* of the bracket 11.

Figure 5A:
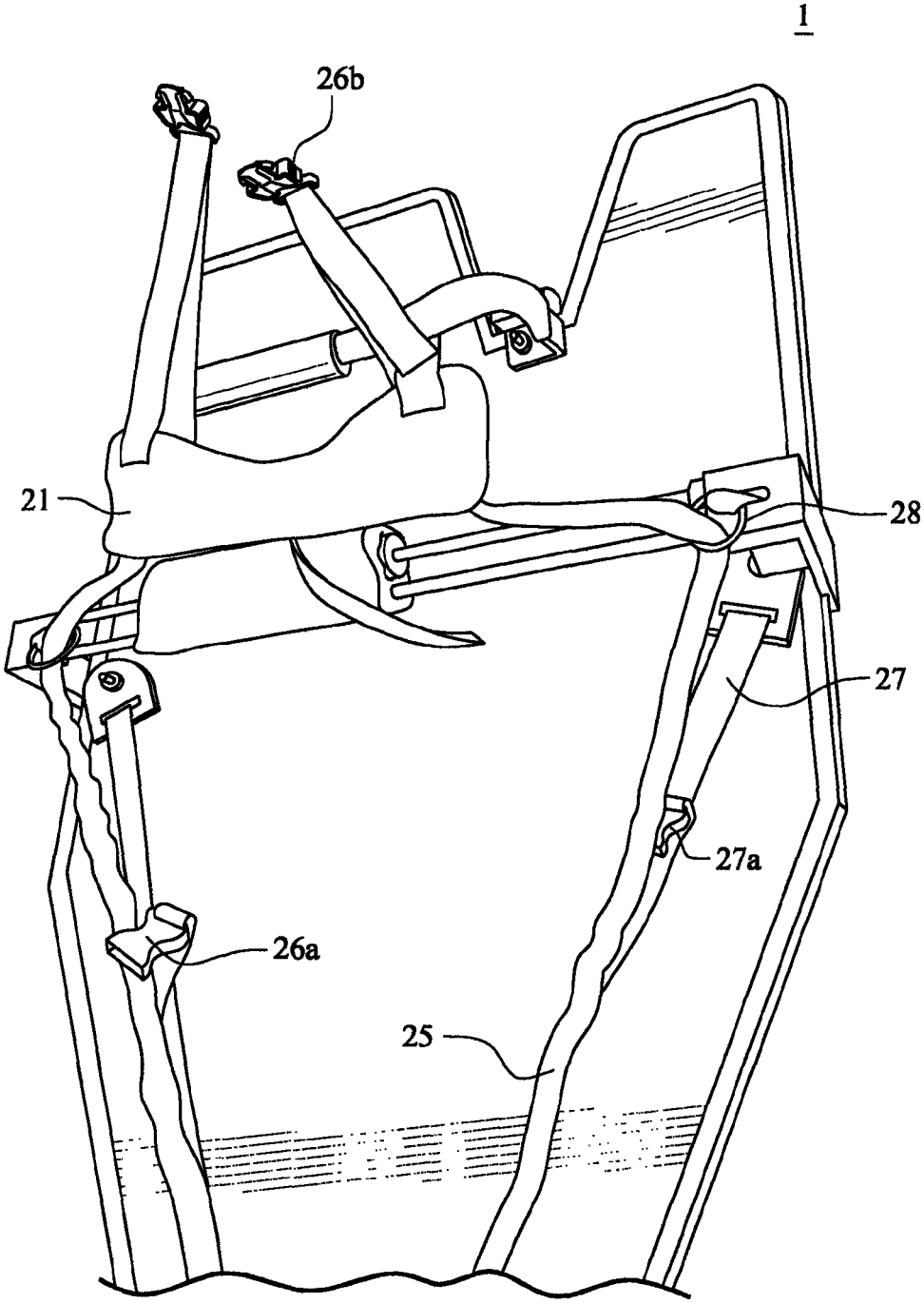
FIG. 5*a* depicts another perspective view of the ballistic protection apparatus using a spreader assembly.

FIG. 5*a* depicts another view using the spreader assembly 21. As explained above, the spreader assembly 21 can be configured to be attached to the apparatus 1 or can be removably attached to another device or an operator. For example, the operator may have a vest or harness that the spreader assembly 21 can attach to. Similarly, the spreader assembly 21 may attach the apparatus 1 to a moving vehicle so that the user can store the apparatus 1 on the vehicle and quickly remove the apparatus 1 from the vehicle when needed.

As can be seen in FIG. 5*a*, the spreader assembly 21 has the bungee cords 25 attached to the assembly. The bungee cords 25 are also attached to the apparatus 1 and allow the spreader assembly 21 to flexibly move into various positions. The bungee cords 25 can be affixed to straps 27 by inserting the bungee cords 25 through strap rings 27*a*. The bungee cords 25 can also be secured to the brackets 11 by inserting the bungee cords 25 through bracket connection rings 28. This configuration allows the spreader assembly 21 to be secured to both the apparatus 1 and the brackets 11.

As can be seen in FIG. 1, the spreader assembly 21 attaches to the bungees 25 and belt 27 by connecting the buckle 26. In this configuration, the spreader assembly 21 can allow an operator to insert his/her arm underneath and through the spreader assembly 21 and grip the apparatus 1 by holding the handle 13.

In FIG. 5*a* however, the spreader assembly 21 is detached from the buckle 26 as can be seen by the dangling buckle female end 26*a* and the buckle male end 26*b*. In this manner, the spreader assembly 21 can be attached to an operator or another device, as exemplified below.

Figure 5B:
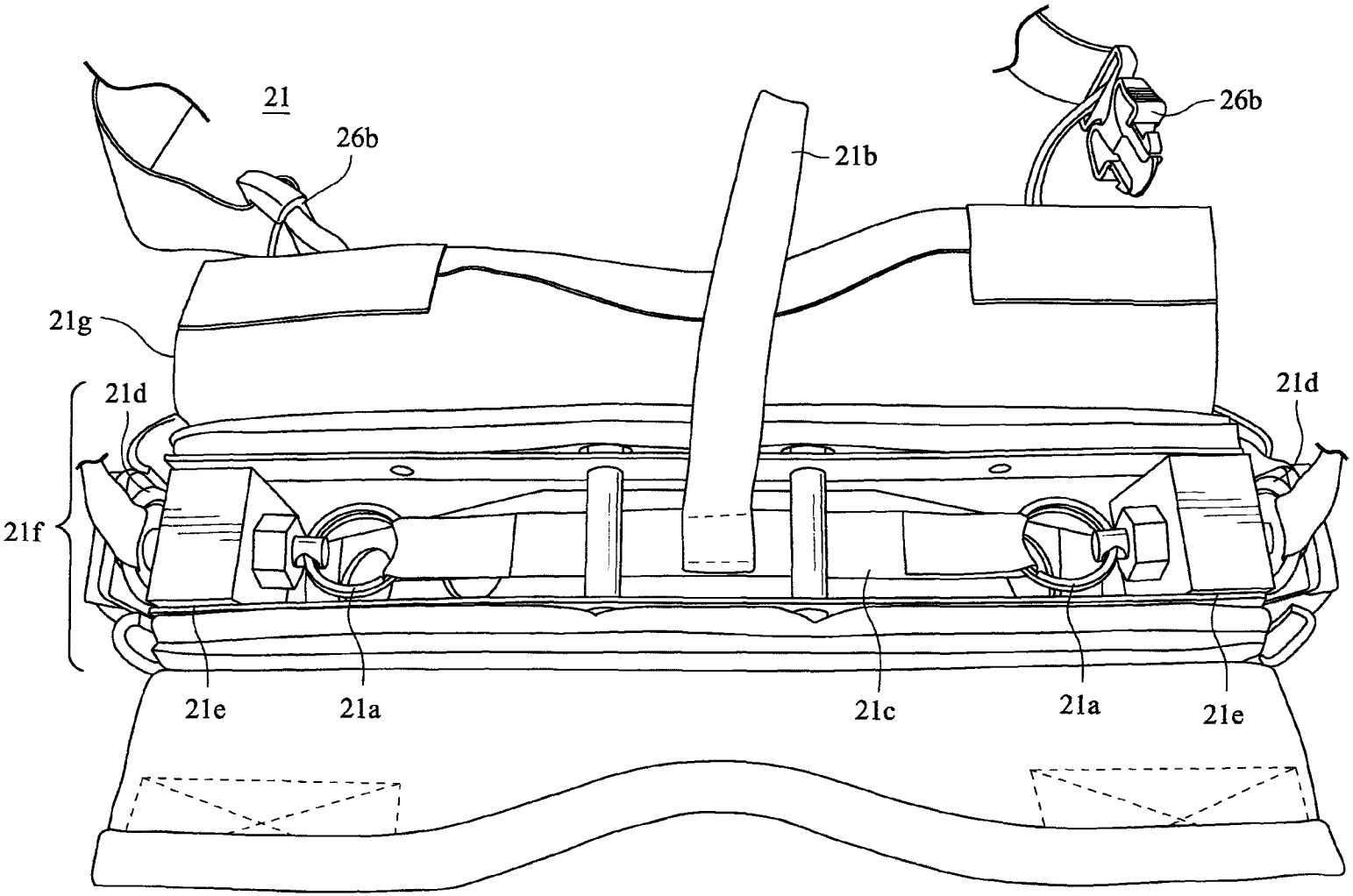
FIG. 5*b* shows an example of an exploded view of the spreader assembly.

FIG. 5*b* shows an exploded view of the spreader assembly 21. The spreader assembly 21 has a spreader frame portion 21*f* and a spreader cover portion 21*g* that covers the frame portion 21*f*. The spreader cover portion 21*g* can wrap around the frame portion 21*f* and connect as one piece using a fastening material, such as Velcro, for example. The spreader assembly 21 also has male-ended buckles 26*b* attaches to the assembly 21 to connect to a person or device.

The spreader assembly 21 has bungee rings 21*d* that allow the spreader assembly to connect to the bungee cords 25. These bungee rings 21*d* are inside the frame portion 21*f* and attach to the spreader assembly 21 using pins 21*a*. As can be seen in FIG. 5*b*, the pins 21*a* are inserted through nylon blocks 21*e* where the distal end of the pins 21*a* connect to the bungee rings 21*d*. The bungee rings can, for example, be positioned around the distal end of the pins 21*a* so that the pin essentially is inserted through the bungee rings 21*d*.

The frame portion 21*a* also has a connecting strap 21*c* that connects two or more pins 21*a* to each other. In this manner, the pins 21*a* can both be easily removed by pulling on the connecting strap 21*c*. The frame portion 21*a* also has a release strap 21*b* that is connected to the connecting strap 21*c*.

The pins 21*a* can be configured so that they have spring tension in the pins 21*a*. As such, the pins 21*a* can be disconnected from the frame portion 21*f* by pulling the pins 21*a* from the frame portion 21*f*. One way in which the pins can be released from the frame portion 21*f* is by pulling on the release strap 21*b*. By pulling on the release strap 21*b*, the connecting strap 21*c* will pull on the pins 21*a* thereby releasing them from the frame portion 21*f*. Such a configuration allows for quick release of the spreader assembly 21 from the bungee cords 25.

The spreader assembly 21 provides the advantage of allowing a user to both hold the apparatus 1 by placing his/her arm underneath the assembly 21 while gripping the handle 13. The spreader assembly 21 also advantageously allows a user to quickly detach the assembly 21 from the apparatus 1 so that the assembly 21 can connect the apparatus 1 to a user or some other device. In essence, the spreader assembly 21 can allow for connection portability in the apparatus 1 so that a user can use the assembly 21 to hold the apparatus 1 or attach the apparatus 1 to the user or another device (e.g., a vehicle). That is, the user does not have to attach/detach several different components when adding/removing the apparatus 1 but can simply attach/detach buckles on the spreader assembly 21 to quickly and portably use the apparatus 1.

Figure 6A:
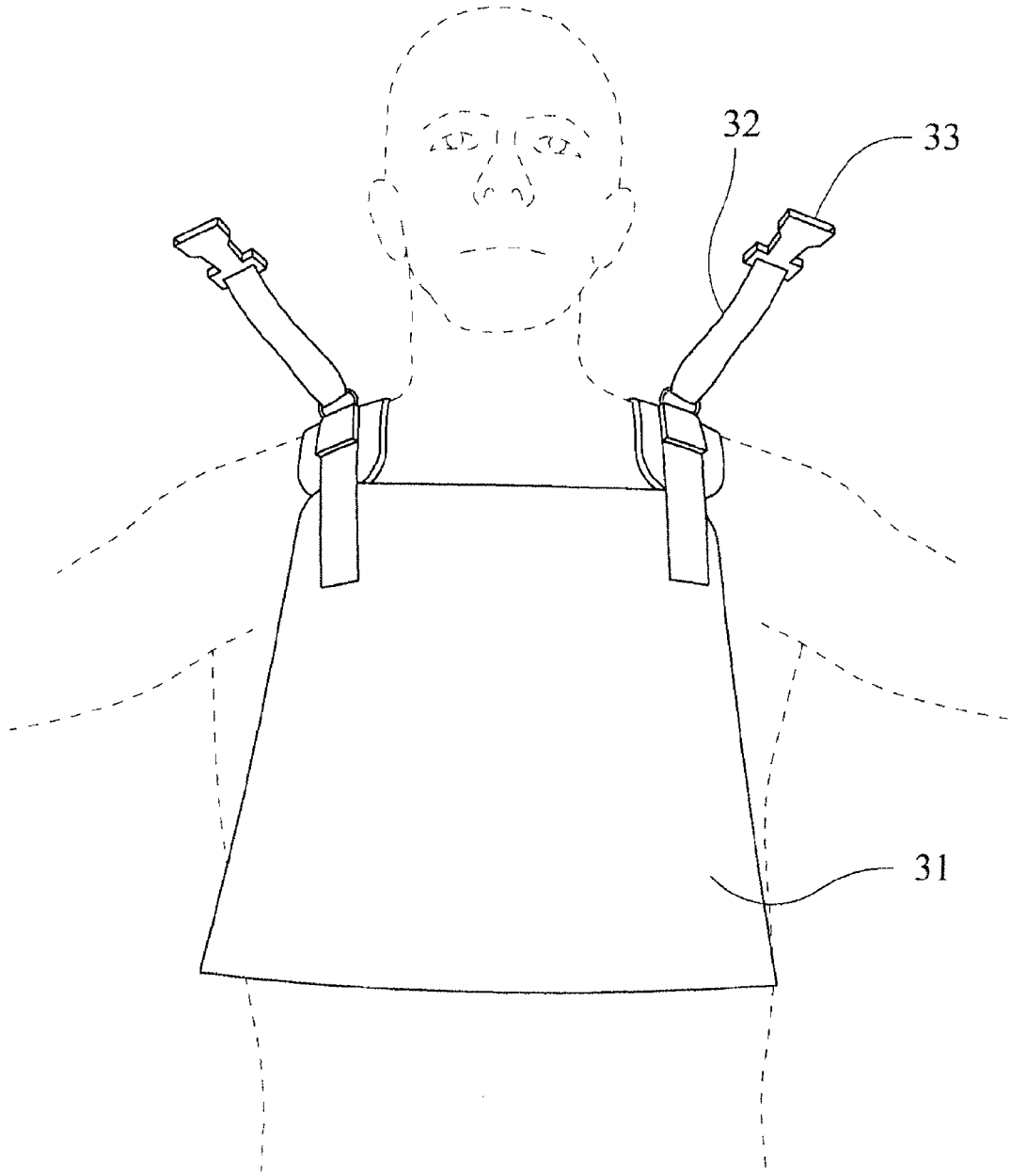
FIG. 6*a* shows an example of an operator having a vest that can connect to the ballistic protection apparatus.

FIG. 6*a* shows an example of an operator having a device that can connect to the ballistic protection apparatus 1. In the example shown in FIG. 6*a*, the operator has a vest 31 that is worn by the operator where the vest 31 has straps 32 and buckles 33 located at the end of the straps 32. The buckles 33 in this example are female-ended so as to accept a male-ended buckle. So male-ended buckles 26*b* may connect to the vest 31 by attaching to the female-ended buckles 33.

Figure 6B:
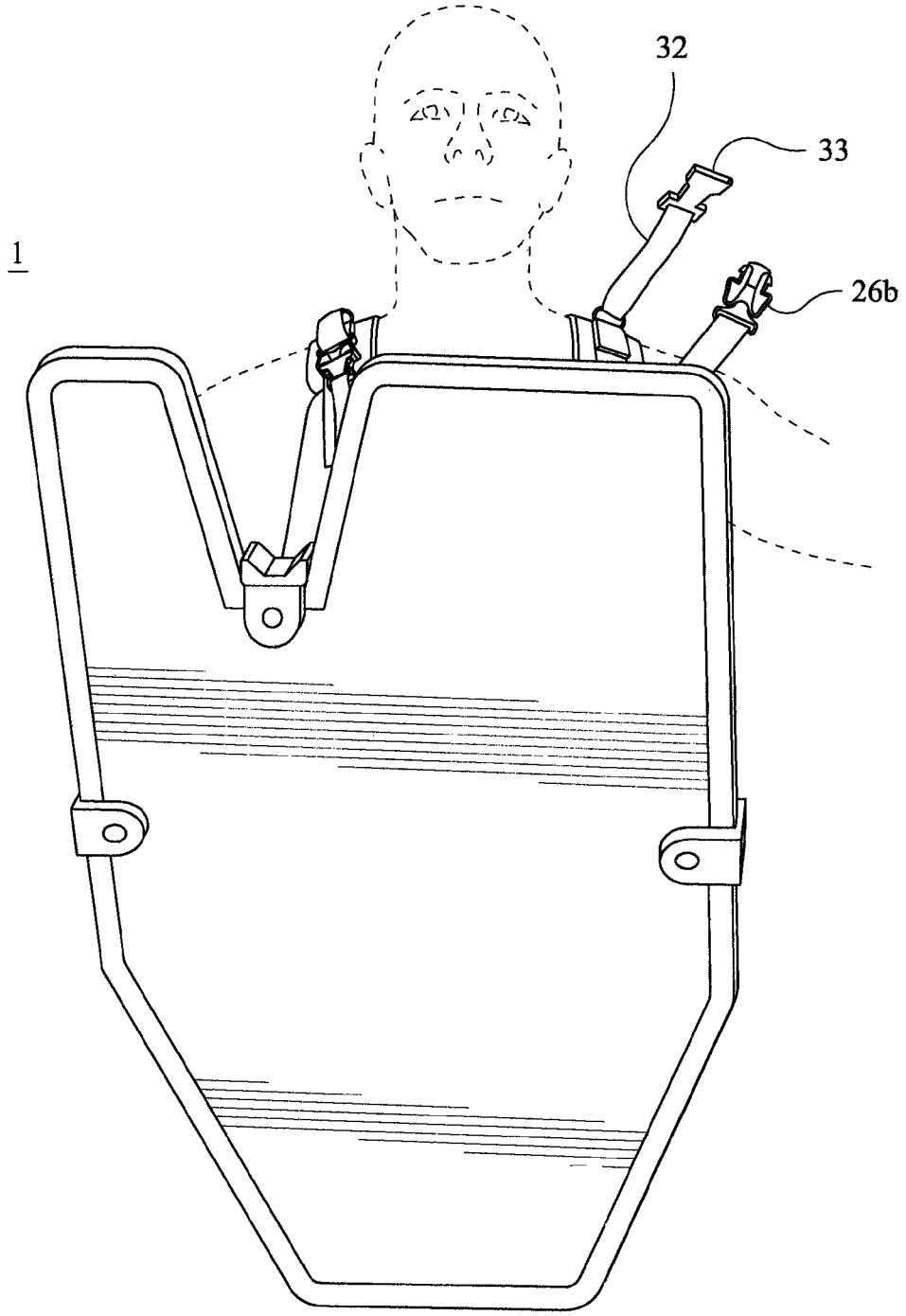
FIG. 6*b* shows an example of the ballistic protection apparatus being connected to the operator's vest.

FIG. 6*b* shows an example of the ballistic protection apparatus 1 being connected to the user. As can be seen in FIG. 6*b*, the user has the benefit of having the apparatus 1 attached to the user's person without the using having to use his/her hands while being positioned to allow unrestricted access the user's weapon without interference to the weapon or the weapon's sling.

Figure 7A:
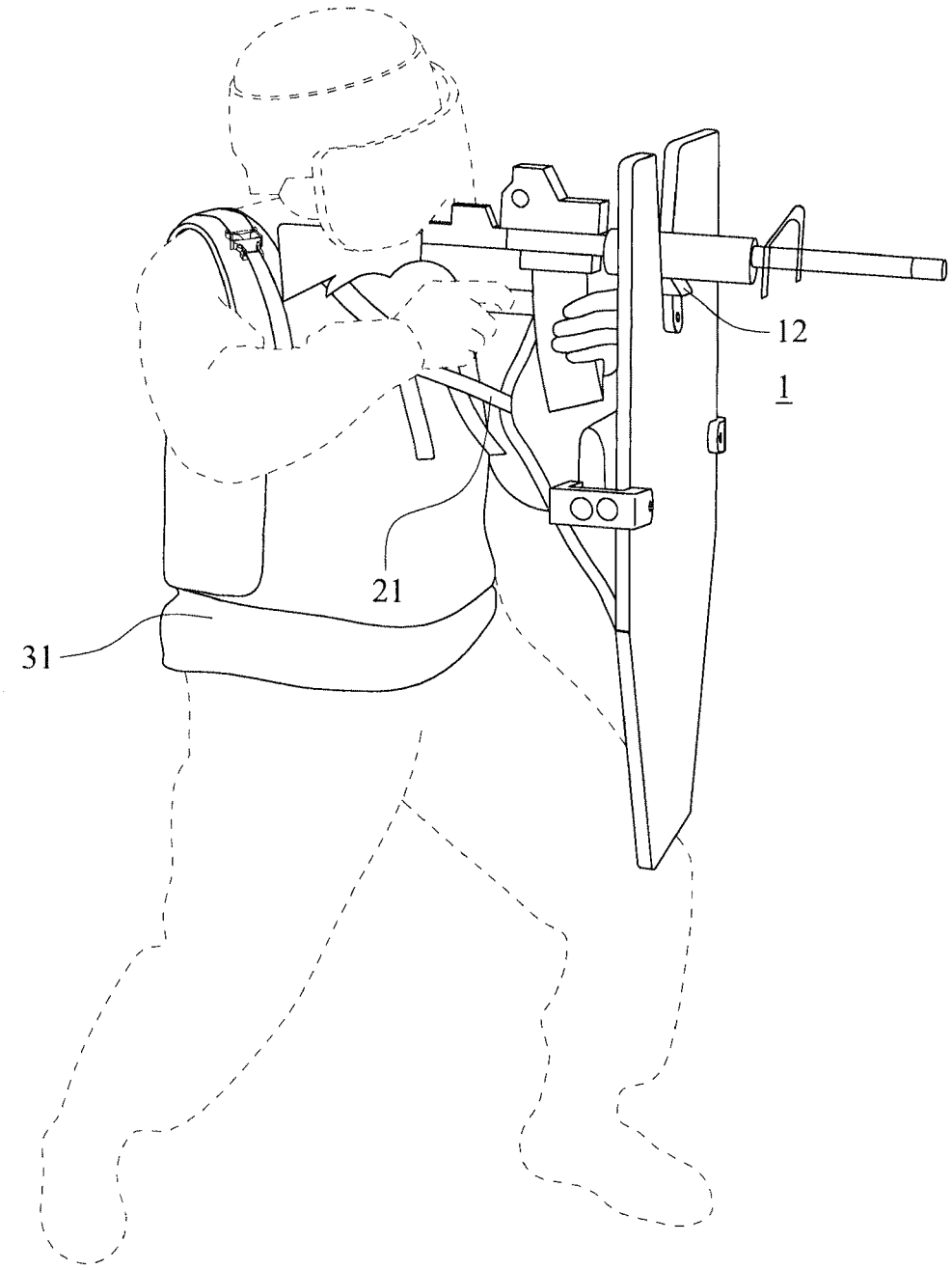
FIGS. 7A-7C show examples of different configurations for operating the ballistic protection apparatus.
Figure 7B:
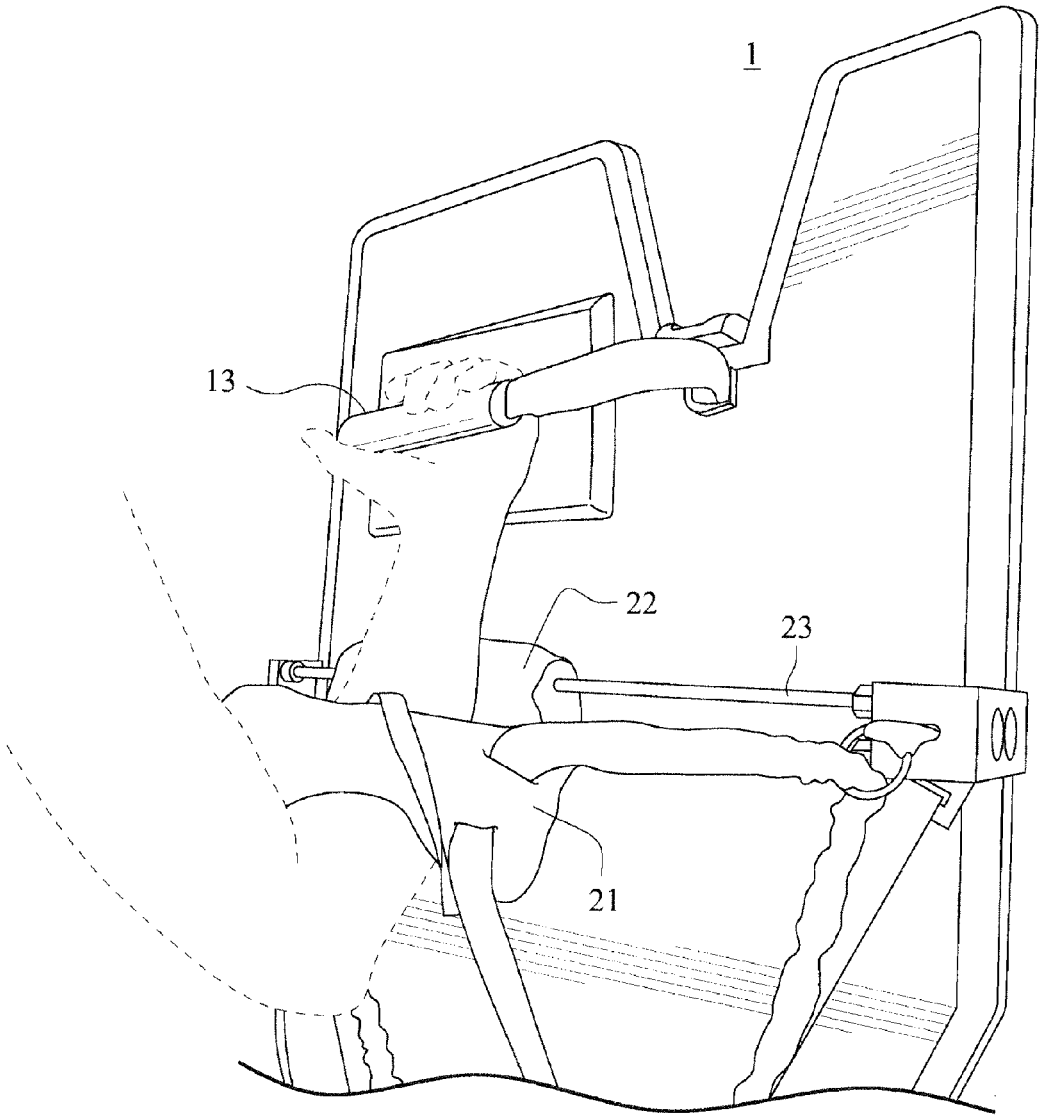
Figure 7C:
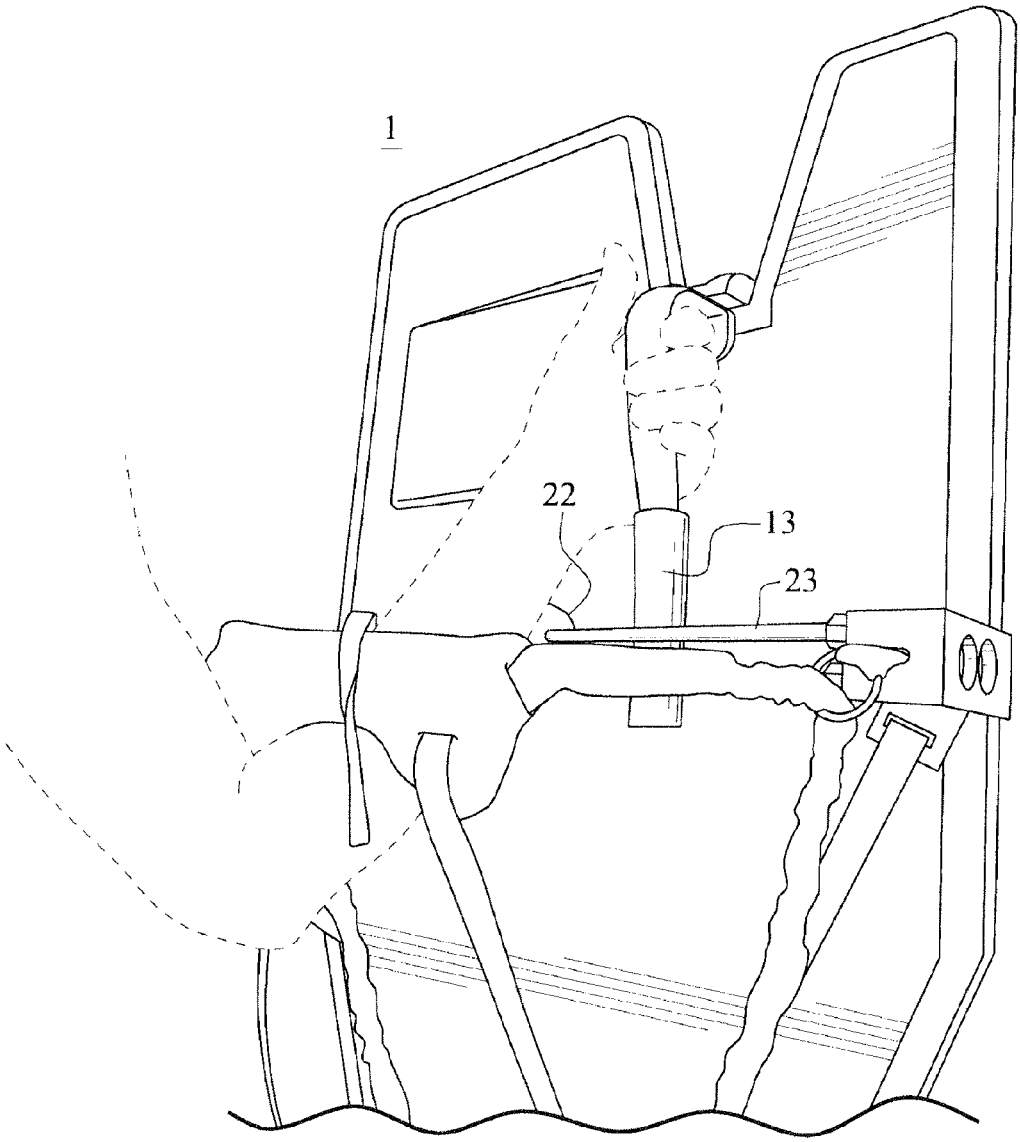

FIGS. 7A-7C show examples of different configurations for operating the ballistic protection apparatus 1. For example, FIG. 7A shows an operator in full armor mounting a weapon through the ballistic protection apparatus 1. The spreader assembly 21 in this example is connected to a vest 31 of the user using the connection portions as discussed above. The user can advantageously rest the apparatus 1 on his/her leg while mounting and firing a weapon resting in the weapon support device 12 on the apparatus 1.

FIG. 7B shows another example for holding the ballistic protection apparatus 1. In this example, the spreader assembly 21 is attached to the apparatus 1 and the user has inserted his/her hand underneath the spreader assembly 21 so that it is positioned between the assembly 21 and the pad 22. The user can grip the shield by holding the handle 13 which, in this example, is in a position such that the length of the handle 13 runs parallel to the rods 23.

FIG. 7C shows an alternate example to FIG. 7B where the user's arm is positioned underneath the assembly 21 and between the assembly 21 and the pad 22. In this example, the user is gripping the handle 13 similar to FIG. 7B, but the handle 13 is positioned so that the length of the handle 13 runs perpendicular to the rods 23.

Figure 8:
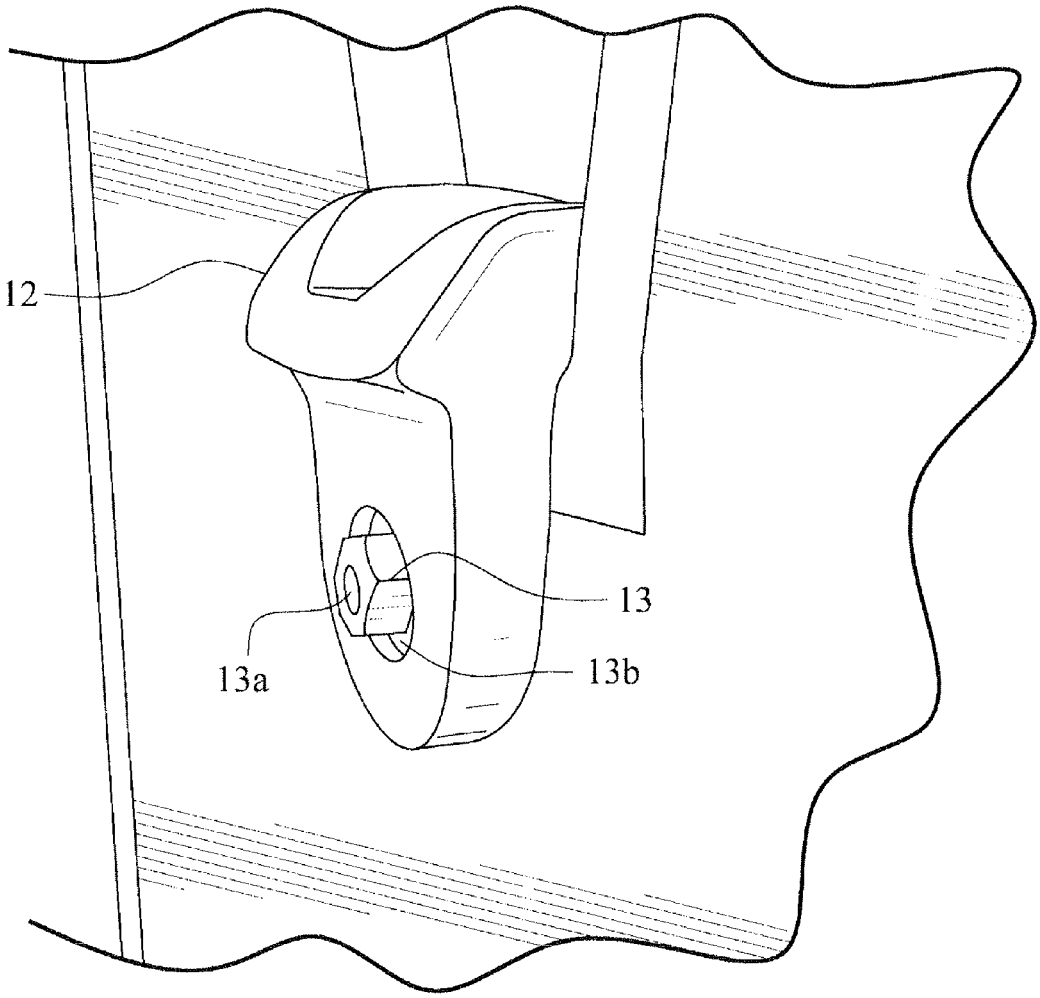
FIG. 8 shows an exploded view of the weapon support device used on the ballistic protection apparatus.

FIG. 8 shows an exploded view of the weapon support device 12. Similar to the configuration of the brackets 11, the weapon support device 12 is configured to be attached to the ballistic protection apparatus 1 using a combination of a bolt 13, a screw 13*a*, and an armored through-bolt 13*b*. In this example, a screw 13*a* is inserted through the armored through-bolt 13*b* on the apparatus 1 where it is fastened by the bolt 13.

The weapon support device 12 can be configured to be placed anywhere on the protection apparatus 1, but in this example, the weapon support device 12 is positioned in a grooved portion at the top of the ballistic protection apparatus 1. As mentioned above, the weapon support device 12 is a piece of armor itself. In this manner, the ballistic protection apparatus 1 will not have a weakness in the area that attaches the weapon support device 12 to the apparatus 1.

Figure 9:
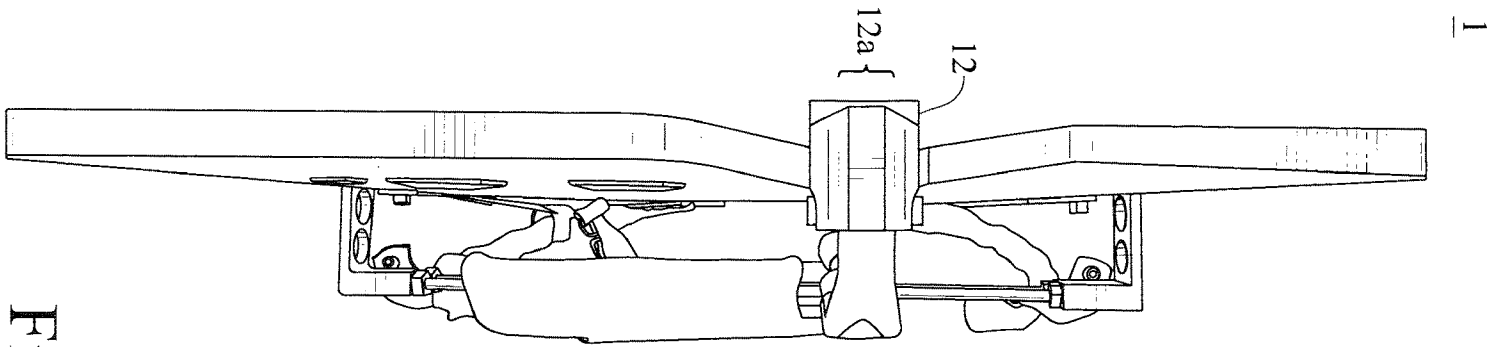
FIG. 9 shows an overhead view of the ballistic protection apparatus and the weapon support device.

FIG. 9 shows an overhead view of the ballistic protection apparatus 1 and the weapon support device 12. The weapon support device 12 has a tapered portion 12*a* that allows a weapon to rest in the weapon support device 12. The tapered portion 12*a* provides the advantage of repositioning a weapon after the weapon is operated.

For example, a user can discharge a weapon that is resting in the weapon support device 12. As the weapon moves forward it will partially slide out of the weapon support device 12 during discharge. By virtue of the tapered portion 12*a*, the weapon will return back to its original resting position in the support device 12 after discharge is finished. This is advantageous in that it allows a user to continually discharge a weapon without having to reposition the weapon in the weapon support device 12 after every time the weapon is used.

While the specification describes what is presently considered to be the most practical and preferred embodiment, it is to be understood that this is not to be limited to the disclosed embodiment, but on the contrary, is intended to cover various modifications and equivalent arrangements included within the spirit and scope of the appended claims.

The invention claimed is:

1. A ballistic protection apparatus, comprising:

a ballistic shield having a body formed at least in part of a ballistic material, the body of the ballistic shield having at least one edge;

a first armored attachment portion having a first bracket assembly, the first bracket assembly has a first collar portion and a second collar portion, both the first and second collar portion are configured to be connected to the first bracket assembly;

a second armored attachment portion having a second bracket assembly, the second bracket assembly has a third collar portion and a fourth collar portion, both third and fourth collar portion are configured to be connected to the second bracket assembly;

a first edge located on a first side of the ballistic shield; and a second edge located on second side of the ballistic shield, the second side directly opposing the first side of the ballistic shield, wherein the first armored attachment portion is coupled to the first edge and the second armored attachment portion is coupled to the second edge, the first armored attachment portion directly opposing the second armored attachment portion.

2. The ballistic protection apparatus of claim 1, wherein the ballistic shield comprises:

a grooved portion on the at least one edge of the ballistic shield; and an opening in a vicinity of the grooved portion, the opening configured to receive connection devices for coupling the armored attachment portion to the ballistic shield.

3. The ballistic protection apparatus of claim 2, further comprising:

a locking device; and a connection device configured to connect the armored attachment portion to the ballistic shield, wherein the connection device is configured to be first inserted into an opening on the armored attachment portion and then inserted into the opening in the vicinity of the grooved portion on the ballistic shield, and the connection device is further configured to be fastened and locked by the locking device so that the armored attachment portion is tightly connected to the ballistic shield.

4. The ballistic protection apparatus of claim 1, further comprising:

a first rod configured to connect to both the first and second bracket assembly; and a second rod configured to connect to both the first and second bracket assembly, wherein the first and second rods lie parallel to each other when connected to the first and second bracket assemblies.

5. The ballistic protection apparatus of claim 4, wherein the first rod is configured to be coupled to and fastened to the first bracket assembly via the first collar portion and configured to be coupled to and fastened to the second bracket assembly via the third collar portion, and the second rod is configured to be coupled to and fastened to the first bracket assembly via the second collar portion and configured to be coupled to and fastened to the second bracket assembly via the fourth collar portion.

6. A ballistic protection apparatus, comprising:

a ballistic shield having a body formed at least in part of a ballistic material; and an attachment portion configured to attach to/detach from the body of the ballistic shield and comprising:

a spreader assembly having a first buckling device, and at least one bungee cord having a second buckling device, the at least one bungee cord coupled to the ballistic shield, wherein the spreader assembly is configured to connect to the at least one bungee cord by connecting the first buckling device to the second buckling device, and wherein the attachment portion is further configured to allow an operator of the ballistic protection apparatus to operate the ballistic protection apparatus with at least one hand of the operator free from holding the ballistic protection apparatus.

7. The ballistic protection apparatus of claim 6, wherein the spreader assembly has a first connection portion; and the at least one bungee cord has a first end configured to connect to the ballistic shield and a second end oppositely located to the first end and configured to connect to the first connection portion of the spreader assembly, wherein the spreader assembly is configured to be operatively detachable from the bungee cord by unbuckling the first buckling device of the spreader assembly from the second buckling device of the at least one bungee cord.

8. The ballistic protection apparatus of claim 6, wherein the spreader assembly is further configured to be attached to the operator so that the operator can use the ballistic protection apparatus without holding the ballistic protection apparatus.

9. The ballistic protection apparatus of claim 8, wherein the spreader assembly is configured to connect to the operator by connecting the first buckling device to a third buckling device.

10. The ballistic protection apparatus of claim 6, wherein two bungee cords are independently mounted in a substantially vertical direction along an inside portion of the ballistic protection apparatus, a bottom end of each of the two bungee cords is mounted at a bottom edge of the ballistic protection apparatus, a top end of each of the two bungee cords is attached to the spreader assembly and positions the two bungee cords to prevent interference with shield operator arm and weapon support, and the two bungee cords assist in positioning the shield and minimizing fatigue for the shield operator.

11. The ballistic protection apparatus of claim 6, wherein metallic and/or fabric support rings allow the at least one bungee cord to expand/contract and assist with an overall balance and load-bearing capability of the ballistic protection apparatus by using a balance and a center-of-gravity of the ballistic protection apparatus to assist in mobility of the apparatus, the first buckling device enables the spreader assembly to be affixed to an inner arm of a shield operator, an upper torso of the shield operator, or a rear portion of a neck of the shield operator, and the spreader assembly is further configured to be detached from the ballistic protection apparatus via at least one pull cord and at least one retractable pin.

12. A ballistic protection apparatus, comprising:

a ballistic shield having a body formed at least in part of a ballistic material, the body of the ballistic shield having at least one edge;

an armored weapon support portion configured to allow an operator to position a weapon in the armored weapon support portion, the armored weapon support portion having a tapered groove configured to hold the weapon and configured to allow the weapon to return to an initial state after weapon operation;

an armored attachment portion attaching to the at least one edge of the body of the ballistic shield, the armored attachment portion configured to armor a portion of the ballistic shield at one or more specific locations at or near the at least one edge of the ballistic shield; and an attachment portion configured to attach to/detach from the body of the ballistic shield, the attachment portion comprising:

a spreader assembly having a first buckling device, and at least one bungee cord having a second buckling device, the at least one bungee cord coupled to the ballistic shield, wherein the spreader assembly is configured to connect to the at least one bungee cord by connecting the first buckling device to the second buckling device, and wherein the attachment portion is further configured to allow an operator of the ballistic protection apparatus to operate the ballistic protection apparatus with at least one hand of the operator free from holding the ballistic protection apparatus.

13. The ballistic protection apparatus according to claim 12, further comprising:

a first armored attachment portion having a first bracket assembly;

a second armored attachment portion having a second bracket assembly;

a first edge located on a first side of the ballistic shield; and a second edge located on a second side of the ballistic shield, the second side directly opposing the first side of the ballistic shield, wherein the first armored attachment portion is coupled to the first edge and the second armored attachment portion is coupled to the second edge, the first armored attachment portion directly opposing the second armored attachment portion.

14. The ballistic protection apparatus according to claim 12, further comprising:

an opening in a vicinity of the grooved portion, the opening configured to receive connection devices for coupling the armored weapon support portion to the ballistic shield;

a locking device; and a connection device configured to connect the armored weapon support portion to the ballistic shield, wherein the connection device is configured to be first inserted into an opening on the armored weapon support portion and then inserted into the opening in the vicinity of the grooved portion on the ballistic shield, and the connection device is further configured to be fastened and locked by the locking device so that the armored weapon support portion is tightly connected to the ballistic shield.

* * * * *